US008256209B2

(12) United States Patent
Rodriguez-Amaya et al.

(10) Patent No.: US 8,256,209 B2
(45) Date of Patent: Sep. 4, 2012

(54) DEVICE AND METHOD FOR REGENERATING A PARTICULATE FILTER

(75) Inventors: Nestor Rodriguez-Amaya, Stuttgart (DE); Volker Reusing, Stuttgart (DE); Stefan Stein, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 920 days.

(21) Appl. No.: 11/996,555

(22) PCT Filed: Jun. 1, 2006

(86) PCT No.: PCT/EP2006/062820

§ 371 (c)(1), (2), (4) Date: Jan. 23, 2008

(87) PCT Pub. No.: WO2007/012512

PCT Pub. Date: Feb. 1, 2007

(65) Prior Publication Data

US 2008/0202102 A1 Aug. 28, 2008

(30) Foreign Application Priority Data

Jul. 26, 2005 (DE) ..... 10 2005 034 704

(51) Int. Cl.
*F01N 3/00* (2006.01)

(52) U.S. Cl. ..... 60/295; 60/303

(58) Field of Classification Search ..... 60/295
See application file for complete search history.

(56) References Cited

U.S. PATENT DOCUMENTS 5,665,318 A * 9/1997 Rembold et al. ..... 422/177
2005/0109028 A1 * 5/2005 Shirakawa et al. ..... 60/602
2005/0247048 A1 * 11/2005 Schaller et al. ..... 60/286

FOREIGN PATENT DOCUMENTS

| | | | |
|---|---|---|---|
| DE | 199 47 197 | A1 | 4/2001 |
| DE | 19947197 | A1 * | 4/2001 |
| EP | 1222370 | B1 | 12/2003 |
| EP | 1244512 | B1 | 2/2005 |
| JP | 8284647 | A | 10/1996 |
| JP | 1061432 | A | 3/1998 |
| JP | 200238939 | A | 2/2002 |
| JP | 200239006 | A | 2/2002 |
| JP | 2002256850 | A | 9/2002 |
| JP | 2004514829 | A | 5/2004 |
| WO | WO 00/79108 | A1 | 12/2000 |
| WO | WO 02/43840 | A1 | 6/2002 |
| WO | WO 2005/045209 | A1 | 5/2005 |

* cited by examiner

*Primary Examiner* — Thomas Denion
*Assistant Examiner* — Jason Shanske
(74) *Attorney, Agent, or Firm* — Michael Best & Friedrich LLP

(57) ABSTRACT

The invention relates to a device for the regeneration, temperature loading and/or thermal management of a component, which is assigned to an exhaust gas system, of an internal combustion engine preferably of a vehicle, having at least one injection valve, which operates preferably in a chatter mode as a function of the pressure of supplied fuel, for injecting fuel for the purpose of regeneration, temperature loading and/or thermal management into the exhaust system of the internal combustion engine. The invention is distinguished by at least one pressure control valve which is arranged upstream of the injection valve and dampens or eliminates pressure fluctuations. The invention also relates to a corresponding method.

16 Claims, 3 Drawing Sheets

DEVICE AND METHOD FOR REGENERATING A PARTICULATE FILTER

CROSS-REFERENCE TO RELATED APPLICATION

This application is a 35 USC 371 application of PCT/EP 2006/062820 filed on Jun. 1, 2006.

BACKGROUND OF THE INVENTION

1. Field of the Invention

The invention relates to a device for regeneration, temperature loading and/or thermal management of a component, associated with an exhaust system, of an internal combustion engine, preferably of a vehicle, the engine being embodied in particular as a diesel engine, having at least one injection valve, operating preferably in the chatter mode as a function of the pressure of supplied fuel, for injecting fuel into the exhaust system of the engine, the fuel serving the purpose of the regeneration, temperature loading and/or thermal management.

2. Description of the Prior Art

In an exhaust system of an internal combustion engine of a vehicle, it is known to install a particulate filter. If the engine is a diesel engine, for instance, then the particulate filter acts as a soot filter and by its filtering action reduces the burden of fine dust. To prevent the filter from clogging after a certain length of time in operation, it is necessary that it be regenerated from time to time. The regeneration is done by raising the temperature, causing the particles, in particular soot particles, to be burned. The temperature increase is done by injecting fuel, such as diesel fuel, into the exhaust system. The injected fuel reaches an oxidation catalytic converter, which is located upstream of the particulate filter. The fuel reaching the oxidation catalytic converter leads to an increase in the exhaust gas temperature, so that correspondingly hot exhaust gases reach the downstream particulate filter, where they bring about the regeneration.

SUMMARY AND ADVANTAGES OF THE INVENTION

To create a simply constructed, functionally reliable device that operates over a wide range of applications, at least one pressure control valve, disposed upstream of the injection valve, that damps or eliminates pressure fluctuations is provided. By means of the pressure control valve, interfering pressure fluctuations that hinder or interfere with the operation, in particular the chatter mode, of the injection valve, can be eliminated. The pressure control valve is therefore disposed upstream (with regard to the fuel supplied) of the injection valve, or in other words precedes it. The injection valve operates as a function of the pressure of the supplied fuel; that is, if the pressure of the fuel exceeds a defined, predeterminable value, then the injection valve opens and injects a quantity of fuel into the exhaust system. As a result, the pressure in the delivery system drops, so that the injection valve closes again. The pressure now rises again, so that injection again occurs. The injection valve thus opens rhythmically, which leads to what is known as the chatter mode already mentioned. Because of the components involved, the fuel delivery to the injection valve is not done at constant pressure; instead, there are pressure fluctuations and sometimes even brief pressure peaks, so that the chatter mode, which for reasons of physics is possible only within a narrow pressure range, is quite likely to be interrupted. By the provision according to the invention, the pressure control valve serves to reduce or diminish pressure fluctuations and/or pressure peaks, so that a reliable chatter mode of the injection valve becomes possible. The aforementioned pressure fluctuations in the fuel supply system originate, among other places, in the fuel pump, for instance, which can be embodied as a geared pump. The individual pumping teeth of the pump cause corresponding pressure peaks, which propagate to the entire system. The fuel injection system also serves to supply the cylinders of the engine from its high-pressure circuit to the associated low-pressure circuit and thus to the fuel delivery system. Preferably, the injection valve and the pressure control valve are in the aforementioned low-pressure circuit, which—with regard to the injection system of the cylinders of the engine—performs prefeeding, for instance at a pressure of approximately 4 bar. In addition, each operating state of the engine has an effect on the low-pressure circuit that performs the fuel feeding, since in a mechanical pump, mechanical coupling of the pump with the engine exists; that is, higher engine speeds lead to a correspondingly higher pump rpm than lower engine speeds. If an electric pump is used as the fuel pump, then the fluctuations otherwise caused by it are absent or only negligibly slight. However, the other pressure fluctuation variables do persist.

In a refinement of the invention, it is provided that the pressure control valve is a valve operating as a function of the applied pressure. Accordingly, it automatically opens at an adjustable opening pressure and closes again once the delivered pressure is less than the opening pressure. In this way, because of the pressure increases or pressure peaks, opening states of the pressure control valve are attained that cause a pressure relief and hence make the pressure uniform; that is, the injection valve is supplied with a "stabilized" fuel pressure.

A refinement of the invention provides that an inlet throttle restriction is connected upstream of the pressure control valve. Accordingly, it is located upstream of the pressure control valve and already brings about a certain evening out of the pressure. The throttle restriction therefore acts in support of the pressure control valve. The throttle restriction is also necessary so as to vary the pressure level of the low-pressure circuit only insignificantly if at all.

It is furthermore advantageous if a stabilizing volume is connected upstream of the pressure control valve. The stabilizing volume located upstream of the pressure control valve likewise has a smoothing function on the fuel pressure in the low-pressure circuit and accordingly is a separate or additional provision for making the fuel pressure more uniform.

In a refinement of the invention it is provided that the injection valve is a spring-loaded first valve. It can also be advantageous if the pressure control valve is a spring-loaded second valve. In both cases, these are mechanical valves, which because of being spring-equipped open when the applied pressure is exceeded and close again as soon as the prevailing pressure drops below a determinable value. It is preferably provided that the opening pressures of both valves, that is, of the injection valve and of the pressure control valve, be adapted to one another in such a way that a prompt, reliable chatter mode of the injection valve ensues; that is, the pressure control valve takes on an effective pressure smoothing function. The pressure characteristics, that is, the opening pressure values of these two valves, can be selected to be different. The same is true for the closing pressure values of the two valves. Fundamentally, however, it is also possible for the two valves to have the same or similar opening and/or closing pressure values.

In a refinement of the invention, it is provided that a safety valve that prevents the delivery of fuel is connected upstream of the injection valve. This safety valve is accordingly located upstream of the injection valve and has the task of preventing the delivery of fuel, in certain situations, such as a vehicle accident, so that there will not be an uncontrolled escape of fuel into the exhaust system.

It is also advantageous if a metering valve that determines the fuel quantity is connected upstream of the injection valve. The metering valve disposed upstream of the injection valve determines time segments within which the regeneration of the particulate filter is to be performed, by opening and enabling the injection of fuel into the exhaust system. Moreover, the fuel quantity introduced by each injection valve can be defined by means of the metering valve. This can be done by either open- or closed-loop control, that is, by control or regulation, and can be dependent on the applicable operating state of the motor vehicle. It is possible to introduce fuel into the exhaust system not only for regenerating the particulate filter by means of the metering valve but also for performing other tasks, such as generating a high temperature in the exhaust system after a cold start so that the functionality of the catalytic converter, which requires a certain operating temperature to function, can be attained quite quickly.

The component associated with the exhaust system may be a particulate filter, for filtering out exhaust particles. Alternatively or in addition, it is also possible for the component to be an $NO_x$, reservoir. By the temperature loading of the $NO_x$ reservoir based on the procedure according to the invention, it is possible to bring about desulfuring of the $NO_x$, reservoir. In addition or as an alternative to the desulfuring, regeneration of the $NO_x$ reservoir by the procedure of the invention can also be done. In addition or as an alternative, it is possible by the procedure of the invention to accomplish tempering, and in particular thermal management; that is, the temperature situation can be varied as desired in the exhaust system.

If a diesel engine is used as the internal combustion engine, then the particulate filter is a diesel particulate filter. This filter prevents diesel soot from escaping into the environment; in other words, the fine dust burden is reduced.

In a refinement, it is provided that the injection valve and the pressure control valve are disposed in a low-pressure region of a fuel injection system of the engine. This has already been mentioned above.

The invention also relates to a method for operating the device described above.

The invention finally relates to a method for regeneration of a particulate filter, associated with an exhaust system, of an internal combustion engine, preferably of a vehicle, having at least one injection valve, operating preferably in the chatter mode as a function of the pressure of supplied fuel, for injecting fuel into the exhaust system of the engine, the fuel serving the purpose of the regeneration, wherein pressure fluctuations in the fuel are diverted upstream of the injection valve.

BRIEF DESCRIPTION OF THE DRAWINGS

Other features and advantages of the invention will become apparent from the detailed description contained below, taken in conjunction with the drawings, in which:

FIG. 1 shows a portion of a low-pressure circuit 1 of a fuel supply of a motor vehicle, not shown in further detail. The low-pressure circuit 1 is supplied by a mechanical fuel feed pump, not shown. The fuel pumps fuel from the tank of the motor vehicle and carries it at low pressure (for instance, 4 bar) to the fuel injection system of the motor vehicle; the fuel injection system has a high-pressure circuit to enable injecting the fuel into the cylinders of an internal combustion engine, not shown, of the vehicle. The fuel is in particular diesel fuel for a diesel engine of the vehicle.

Figure 1:
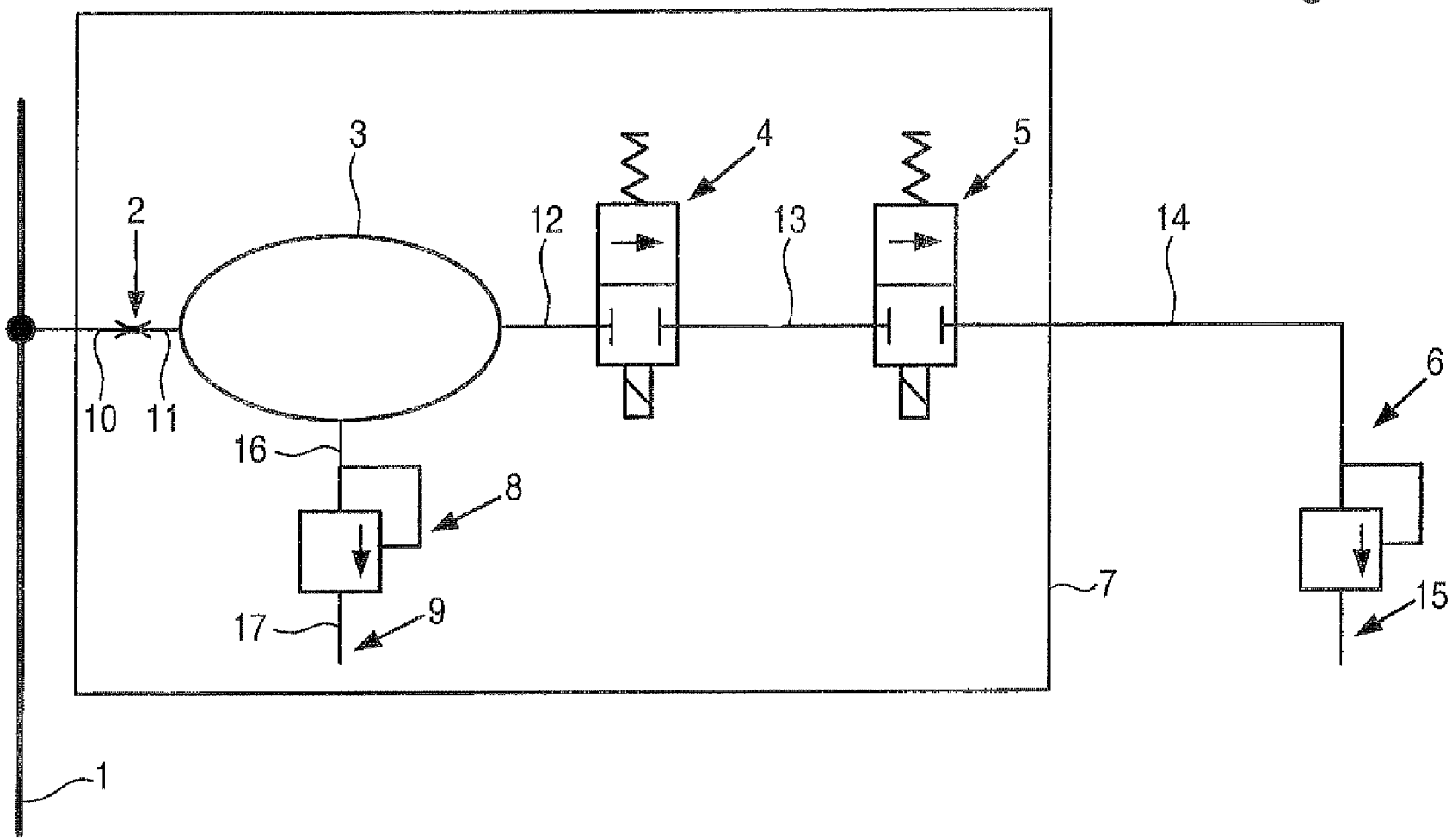
FIG. 1 is a hydraulic circuit diagram of the device for regenerating a particulate filter of an exhaust system of an internal combustion engine of a vehicle.

The low-pressure circuit 1 is connected to the upstream side of an inlet throttle restriction 2, whose downstream side leads to a stabilizing volume 3. What follows are, first, an injection valve 6 and, second, a pressure control valve 8. The stabilizing volume 3 is a fuel-filled chamber whose dimensions are selected to be large enough that damping action is exerted on pressure waves, peaks, and fluctuations of the fuel in the low-pressure circuit 1. A corresponding action is also performed by the inlet throttle restriction 2. All in all, the inlet throttle restriction 2, stabilizing volume 3, and pressure control valve 8 to be described in further detail hereinafter serve to produce an operating pressure, preferably adjustable, that is calmed and adequately free of pressure peaks, pressure fluctuations, and the like. Otherwise, pressure fluctuations are present to a considerable extent in the low-pressure circuit 1, but not upstream of the injection valve 6. A geared pump can generate pressure peaks for instance of 20 bar within milliseconds. This makes it clear that these pressure peaks are far above the average pressure value of the low-pressure circuit (which as mentioned above is 4 bar, for example).

A safety valve 4 is connected to the stabilizing volume 3 and can block off the fuel delivery, for instance in an emergency, among other purposes in order to prevent fuel from running out or being sprayed out in an accident. The downstream side of the safety valve 4 is connected to the upstream side of a metering valve 5. The metering valve 5 can be regulated or controlled in such a way that a desired fuel quantity per unit of time is carried through and delivered to the injection valve 6. The injection valve 6 is disposed such that it injects fuel into an exhaust system, not shown, of the engine. Downstream of the injection valve 6 in the exhaust system is an oxidation catalytic converter, not shown, which upon injection of fuel raises the exhaust gas temperature in the exhaust system so markedly that a particulate filter, disposed downstream of the oxidation catalytic converter in the exhaust system, is regenerated; that is, because of the temperature increase, filtered-out particles, such as soot and other fine dust, so that after the regeneration phase, the particulate filter, cleaned, is again available. In normal operation of the motor vehicle, such regeneration is done approximately every 500 to 1000 kilometers. The temperature in the particulate filter during the regeneration reaches approximately 550 to 600° C.

In FIG. 1, the box drawn around them shows that the inlet throttle restriction 2, stabilizing volume 3, safety valve 4 and metering valve 5 are combined into one component unit 7.

The upstream side of the pressure control valve 8 is connected to the stabilizing volume 3. The downstream side 9 of the pressure control valve 8 leads to the tank of the motor vehicle.

From the above description, it can be seen that by means of fuel lines 10 and 11, the inlet throttle restriction 2 is disposed between the low-pressure circuit 1 and the stabilizing volume 3. A fuel line 12 leads from the stabilizing volume 3 to the upstream end of the safety valve 4. The downstream end of the safety valve 4 communicates with the upstream end of the metering valve 5 via a fuel line 13. The downstream end of the metering valve 5 communicates with the upstream end of the injection valve 6 via a fuel line 14. The downstream end 15 of the injection valve 6 serves to inject fuel into the exhaust system, not shown. The upstream end of the pressure control valve 8 communicates with the stabilizing volume 3 via a fuel line 16. A fuel line 17 connected to the downstream end 9 of the pressure control valve 8 serves to return fuel and preferably leads to the tank of the motor vehicle.

The safety valve 4 and the metering valve 5 are preferably electrically controllable or regulatable and can accordingly be adapted in their function to the applicable driving situation and the prevailing circumstances. The injection valve 6 and the pressure control valve 8 are spring-loaded valves; that is, because of the corresponding spring prestressing forces, each valve does not open until an adjustable operating pressure (opening pressure) is exceeded. The delivered fuel must accordingly have a certain pressure value.

The following function is the result: In the low-pressure circuit 1, the fuel has pressure peaks, pressure waves, and so forth; in other words, there is not a constant pressure value there. The pressure and the pressure peaks of the fuel in the stabilizing volume 3 are slightly reduced, because of the inlet throttle restriction 2. Also because of the inlet throttle restriction 2 and the size of the stabilizing volume 3, additional damping of the pressure fluctuation peaks of the fuel is accomplished and delivered to the injection valve 6 via the fuel lines 12, 13 and 14 as well as the safety valve 4 and the metering valve 5. If regeneration of the particulate filter in the exhaust system is to be performed, the metering valve 5 is in the open position; as a result, the spring-loaded injection valve 6 is opened and fuel is injected into the exhaust system. As a result of the injection, the fuel pressure in the supply line drops, so that the injection valve 6 closes again. This causes a renewed pressure buildup in the fuel line 14, so that once again opening of the injection valve 6 ensues. This process repeats over and over, and the term used for it is the chatter mode of the injection valve 6. This chatter mode, however, is possible only if there are not excessively great pressure fluctuations in the supplied fuel, or in other words in the fuel line 14. Moreover, the chatter mode is possible only within a relatively narrow pressure range. To attain at least partially effective compensation for the pressure fluctuations, pressure waves, pressure peaks, and so forth and thus to make the chatter mode of the injection valve 6 possible, the pressure control valve 8 evens out pressure peaks by diverting them. Whenever an elevated pressure exists, the spring-loaded pressure control valve 8 opens and diverts a corresponding quantity of fuel back to the tank of the motor vehicle, via the fuel line 17. This leads to a corresponding reduction of the pressure in the stabilizing volume 3, with the consequence that a sufficiently constant fuel pressure to perform the chatter mode can be offered to the injection valve 6. Once the applicable pressure peak has been reversed by opening of the pressure control valve 8, this valve closes again, until another fuel pressure peak causes it to open again.

From all this, it becomes clear that the pressure control valve 8 has a compensatory action on pressure peaks, pressure waves, and so forth of the fuel in the system that supplies the injection valve 6 and has all adjusting action on the pressure level. This last phrase means that by suitable design of the components, the pressure level can be adjusted.

The subject of the application can be employed in all known injection systems, regardless of their design, so the range of applications is correspondingly broad. It is preferably connected to the applicable low-pressure circuit. By means of the chatter mode of the injection valve 6, very good atomization of the fuel in the exhaust system can be brought about. Good spray preparation is necessary so that the fuel, in particular diesel fuel will be completely vaporized in the exhaust system. Because of the pressure control valve 8 according to the invention, a low pressure in the delivery region of the injection valve 6 can be brought about that fluctuates substantially less, and thus the chatter mode can be attained perfectly and reliably. It is understood to be possible for there not merely to be one injection valve 6 but rather a plurality of injection valves 6 for injecting fuel into the exhaust system. There can also be more than one pressure control valve. The goal of the invention is that the injection valve 6, instead of following existing pressure fluctuations of the system, will enter its chatter mode; that is, because of the compensatory effect of the pressure control valve 8, influence is exerted on the operation of the injection valve 6.

It is understood that variations of the circuit of FIG. 1 are possible; for instance, the pressure control valve 8 may be disposed between the safety valve 4 and the metering valve 5, or downstream of the metering valve 5, in that case between the metering valve 5 and the injection valve 6.

Figure 2:
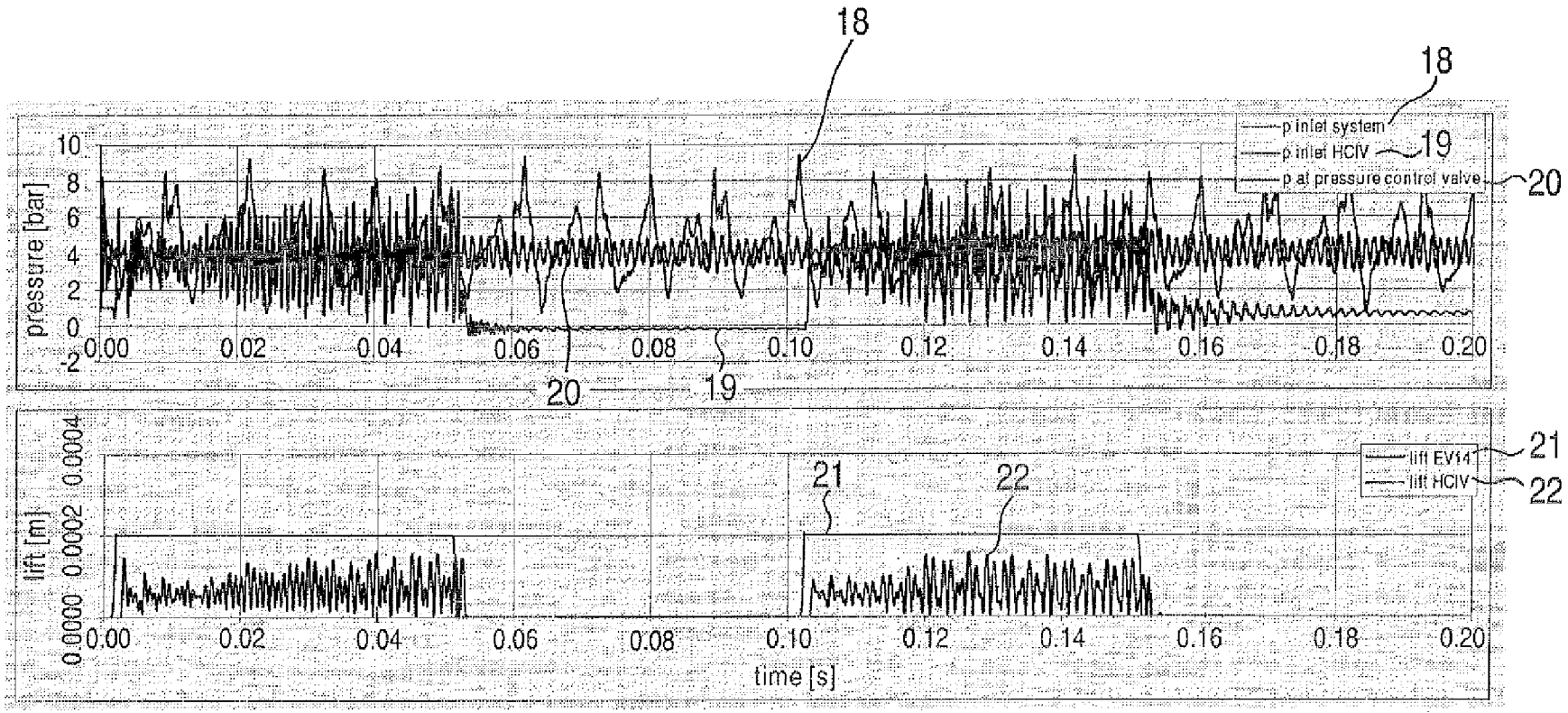
FIG. 2 shows two graphs of a first exemplary embodiment of the invention.
Figure 3:
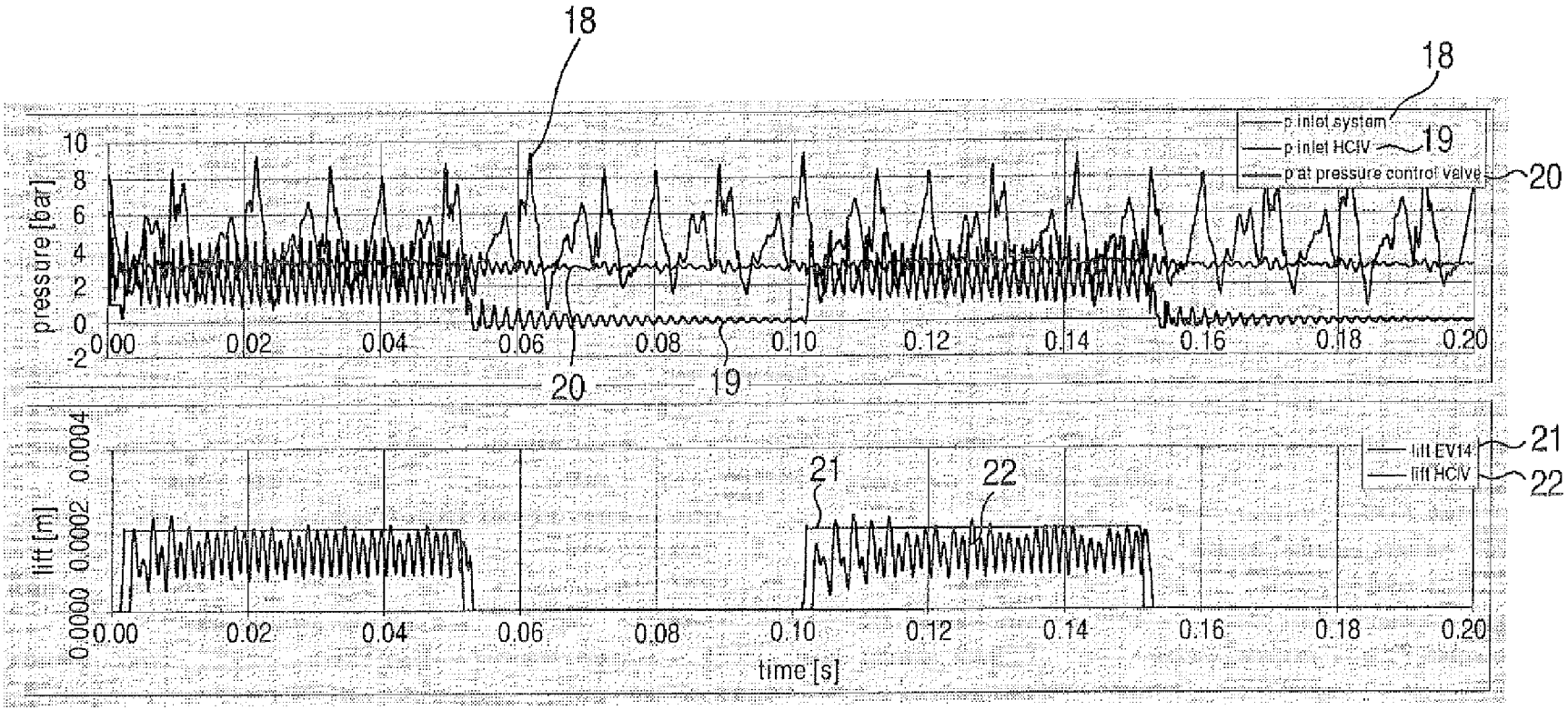
FIG. 3, shows two graphs of a second exemplary embodiment of the invention.

The graphs in FIGS. 2 and 3 illustrate the function, already described in detail above, of the subject of the invention. In the upper graph in FIG. 2 and the upper graph in FIG. 3, the pressure (on the ordinate) is plotted over time (on the abscissa). The lower graphs in FIGS. 2 and 3 show a valve needle lift (on the ordinate) plotted over time (on the abscissa).

FIG. 2 applies to a system in accordance with FIG. 1, which employs a low pressure of 4 bar (mean value). In FIG. 3, this mean value is 3 bar. In the upper diagrams of FIGS. 2 and 3, reference numeral 18 indicates the pressure of the fuel in the low-pressure circuit 1 (p inlet system). Reference numeral 19 indicates the course of the fuel pressure prevailing at the upstream end of the injection valve 6, or in other words in the fuel line 14 (p inlet HCIV). Reference numeral 20 indicates the pressure at the pressure control valve 8 (p at pressure control valve). In the lower graphs of each of FIGS. 2 and 3, reference numeral 21 indicates the valve lift of the metering valve 5 (lift EV14). Reference numeral 22 indicates the valve lift of the injection valve 6 (lift HCIV).

Viewed from left to right (on the time axis), it can be seen from FIGS. 2 and 3 that the metering valve 5 is first opened for a defined length of time, then closed, then opened again, and then closed again. This leads to a corresponding metering of fuel. According to reference numeral 18, the system pressure, that is, the pressure in the low-pressure circuit 1, extends over the entire abscissa, with corresponding pressure peaks and pressure drops that each remain the same throughout. This is equally true for FIG. 2 and FIG. 3. The pressure fluctuations at the pressure control valve 8 are also uniform over the entire length of the abscissa (in both FIG. 2 and FIG. 3). From the pressure course at the inlet of the injection valve 6 (reference numeral 19), it is clear that in the phases when the metering valve 5 is open, a uniform chatter mode prevails; that is, the pressure course at the injection valve 6 does not follow the pressure course in the low-pressure circuit 1. In the phases when the metering valve 5 is closed, the pressure at the injection valve 6 drops to zero. The chatter mode of the injection valve 6 can be seen in the lower graphs of FIGS. 2 and 3 as well, where it is identified by reference numeral 22, which indicates the valve lift of the injection valve 6.

The foregoing relates to a preferred exemplary embodiment of the invention, it being understood that other variants and embodiments thereof are possible within the spirit and scope of the invention, the latter being defined by the appended claims.

The invention claimed is:

1. A device for regeneration, temperature loading and/or thermal management of a component, associated with an exhaust system, of an internal combustion engine, the device comprising:

at least one injection valve operating in chatter mode as a function of the pressure of supplied fuel, for injecting fuel into the exhaust system of the engine for the regeneration, temperature loading, and/or thermal management of the component;

at least one pressure control valve disposed upstream of the injection valve, the pressure control valve operable to damp or eliminate pressure fluctuations, the device being connected to a low-pressure circuit that carries fuel under low pressure to a fuel injection system of the internal combustion engine which has a high-pressure circuit to enable injecting fuel into cylinders of the internal combustion engine; and a stabilizing volume disposed in a low-pressure region of the fuel injection system and being connected upstream of the pressure control valve.

2. The device as defined by claim 1, wherein the pressure control valve is a valve operating as a function of applied pressure.

3. The device as defined by claim 1, further comprising an inlet throttle restriction connected upstream of the pressure control valve.

4. The device as defined by claim 1, wherein the injection valve and the pressure control valve are disposed in the low-pressure region of the fuel injection system of the engine.

5. The device as defined by claim 1, further comprising a fuel return communicating with the pressure control valve on its outlet side.

6. The device as defined by claim 1, wherein the injection valve is a spring-loaded first valve.

7. The device as defined by claim 6, wherein the pressure control valve is a spring-loaded second valve.

8. The device as defined by claim 1, further comprising a safety valve connected upstream of the injection valve and preventing the delivery of fuel.

9. The device as defined by claim 2, further comprising a safety valve connected upstream of the injection valve and preventing the delivery of fuel.

10. The device as defined by claim 4, further comprising a safety valve connected upstream of the injection valve and preventing the delivery of fuel.

11. The device as defined by claim 1, further comprising a metering valve connected upstream of the injection valve, the metering valve being operable to determine the fuel quantity delivered.

12. The device as defined by claim 1, wherein the component is a particulate filter or an $NO_x$ reservoir.

13. The device as defined by claim 12, wherein the particulate filter is a diesel particulate filter.

14. A method for operating a device as defined by claim 1 comprising damping or eliminating pressure fluctuations upstream of the injection valve with the pressure control valve.

15. A method performed by the device according to claim 1, for regeneration, temperature loading, and/or thermal management of a component, associated with an exhaust system, of an internal combustion engine having at least one injection valve operating in chatter mode as a function of the pressure of supplied fuel, for injecting fuel into the exhaust system of the engine, the fuel serving the purpose of the regeneration, temperature loading, and/or thermal management of the component, the method comprising diverting pressure fluctuations in the fuel upstream of the injection valve.

16. The device as defined by claim 4, further comprising an inlet throttle restriction connected upstream of the pressure control valve.

* * * * *